US008167535B2

(12) United States Patent
Parry et al.

(10) Patent No.: US 8,167,535 B2
(45) Date of Patent: May 1, 2012

(54) SYSTEM AND METHOD FOR PROVIDING SUPERCRITICAL COOLING STEAM INTO A WHEELSPACE OF A TURBINE

(75) Inventors: William T. Parry, Rexford, NY (US); Christopher M. Tomaso, Albany, NY (US)

(73) Assignee: General Electric Company, Schenectady, NY (US)

( * ) Notice: Subject to any disclaimer, the term of this patent is extended or adjusted under 35 U.S.C. 154(b) by 950 days.

(21) Appl. No.: 12/178,788

(22) Filed: Jul. 24, 2008

(65) Prior Publication Data

US 2010/0021283 A1 Jan. 28, 2010

(51) Int. Cl.
*F04D 29/58* (2006.01)

(52) U.S. Cl. ..... 415/115; 415/114; 415/116

(58) Field of Classification Search ..... 425/114, 425/115, 116

See application file for complete search history.

(56) References Cited

U.S. PATENT DOCUMENTS

| | | | | |
|---|---|---|---|---|
| 4,309,873 | A | 1/1982 | Koran et al. | |
| 5,253,976 | A * | 10/1993 | Cunha | 415/114 |
| 5,320,483 | A * | 6/1994 | Cunha et al. | 415/114 |
| 5,340,274 | A * | 8/1994 | Cunha | 415/115 |
| 6,224,327 | B1 * | 5/2001 | Aoki et al. | 415/115 |
| 6,397,604 | B2 * | 6/2002 | Eldrid et al. | 60/782 |
| 6,779,972 | B2 | 8/2004 | Farrell et al. | |
| 6,896,482 | B2 | 5/2005 | Parry | |
| 7,003,956 | B2 * | 2/2006 | Yamashita et al. | 60/646 |

FOREIGN PATENT DOCUMENTS

| | | | |
|---|---|---|---|
| JP | 9-250306 | A | 9/1997 |
| WO | WO 01/86121 | A1 | 11/2001 |

* cited by examiner

*Primary Examiner* — Jarrett Stark
*Assistant Examiner* — Nicholas Tobergte
(74) *Attorney, Agent, or Firm* — Nixon & Vanderhye P.C.

(57) ABSTRACT

A system for cooling a high pressure section of a turbomachine includes a conduit configured to carry cooling steam from a boiler to a space upstream of a first stage nozzle of the turbomachine. The conduit extends through a housing of the turbomachine and a nozzle diaphragm of the first stage nozzle. The system further includes a control valve in the conduit configured to regulate the flow of cooling steam. A turbomachine includes a housing; a turbine shaft rotatably supported in the housing; and a plurality of turbine stages located along the turbine shaft and contained within the housing. Each turbine stage includes a diaphragm attached to the housing. The diaphragm comprises a plurality of nozzles. A hole is provided in the diaphragm upstream of a first stage of the plurality of stages for the introduction of cooling steam. A method of cooling a high pressure section of a turbomachine includes introducing cooling steam into the turbomachine through the at least one hole.

20 Claims, 3 Drawing Sheets

SYSTEM AND METHOD FOR PROVIDING SUPERCRITICAL COOLING STEAM INTO A WHEELSPACE OF A TURBINE

The invention relates to the use of cooling steam provided from a boiler for limiting metal stresses in a turbine of a turbomachine.

BACKGROUND OF THE INVENTION

WO 01/86121 A1 discloses a method for cooling a shaft in a high-pressure expansion section of a steam turbine. A steam generator is provided to produce live steam with a temperature and a pressure that is higher and lower, respectively, than cooling steam that is removed from the steam generator for cooling the shaft. A high pressure expansion section is provided with a feed for the cooling steam.

Japanese Patent Application Publication 9-250306 discloses that steam bred from an intermediate stage of a boiler is mixed with high pressure initial stage nozzle outlet leak steam to prevent lowering of material force of an intermediate pressure initial stage bucket stud part.

BRIEF DESCRIPTION OF THE INVENTION

In one embodiment of the invention, a system for cooling a high pressure section of a turbomachine comprises a conduit configured to carry cooling steam from a boiler to a space upstream of a first stage nozzle of the turbomachine. The conduit extends through a housing of the turbomachine and a nozzle diaphragm of the first stage nozzle. The system further comprises a control valve in the conduit configured to regulate the flow of cooling steam.

In another embodiment of the invention, a turbomachine comprises a housing; a turbine shaft rotatably supported in the housing; and a plurality of turbine stages located along the turbine shaft and contained within the housing. Each turbine stage comprises a diaphragm attached to the housing. The diaphragm comprises a plurality of nozzles. A hole is provided in the diaphragm upstream of a first stage of the plurality of stages for the introduction of cooling steam.

In a further embodiment of the invention, a method of cooling a high pressure section of a turbomachine is provided. The turbomachine comprises a housing, a turbine shaft rotatably supported in the housing, and a plurality of turbine stages located along the turbine shaft and contained within the housing. Each turbine stage comprises a diaphragm attached to the housing. The diaphragm comprises a plurality of nozzles and at least one hole provided in the diaphragm upstream of a first stage of the plurality of stages. The method comprises introducing cooling steam into the turbomachine through the at least one hole.

DETAILED DESCRIPTION OF THE INVENTION

Figure 1:
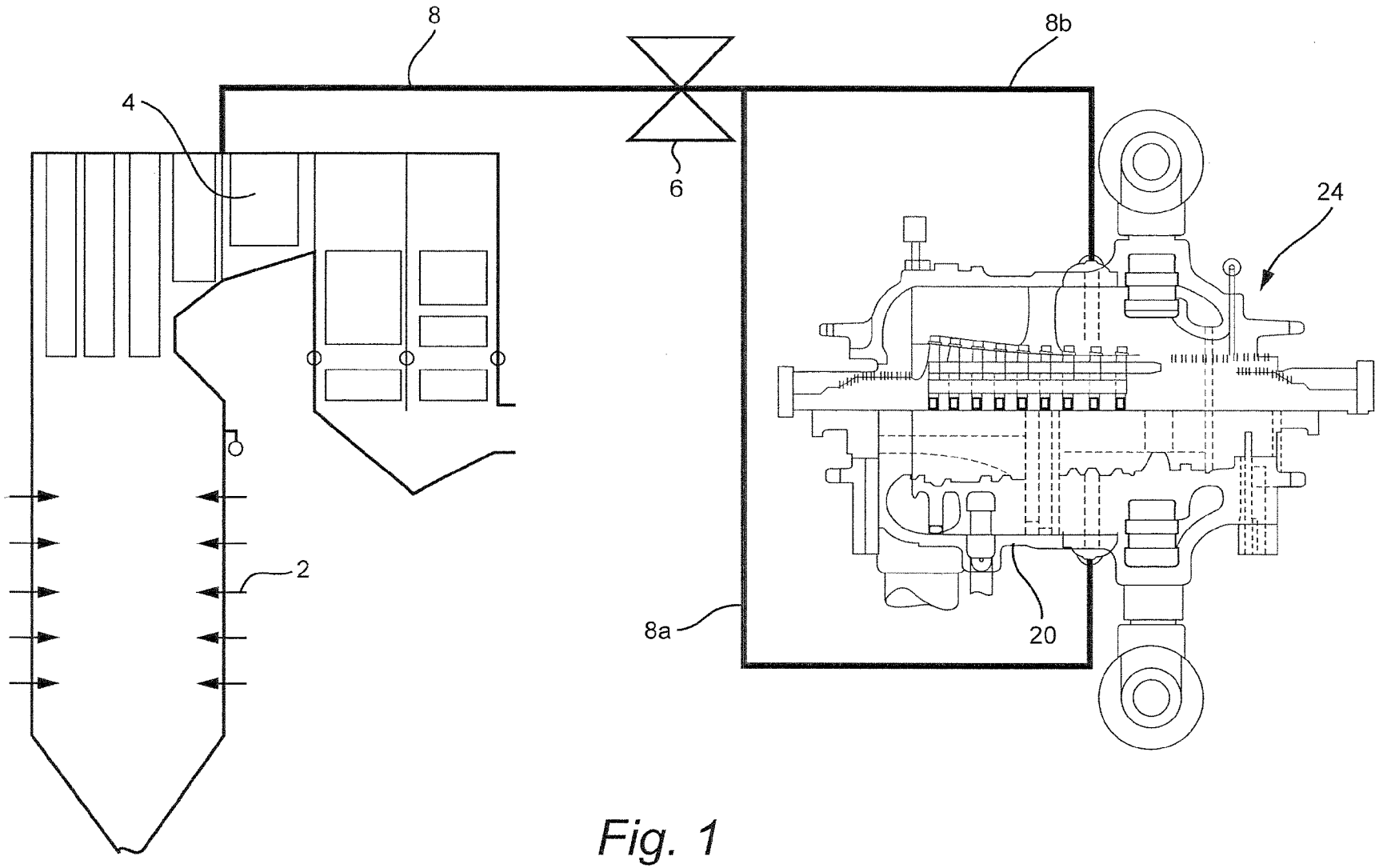
FIG. 1 schematically depicts one embodiment of a high pressure cooling system.

Referring to FIG. 1, a boiler is configured to provide steam to a turbine 24 of a turbomachine. The boiler 2 includes a plurality of superheaters and reheaters. As shown in FIG. 1, a conduit, or pipe 8, is provided at the final superheater 4 of the boiler 2 to provide cooling steam to the turbine 24.

The pipe 8 has a control valve 6 that allows the flow of cooling steam to be adjusted in accordance with the load requirements of the turbine 24. The flow of cooling steam travels along the pipe 8 and is fed to the turbine 24 through the outer housing or shell 20 of the turbine 24. The pipe 8 is branched off into a first branch 8*a* and a second branch 8*b*.

Figure 2:
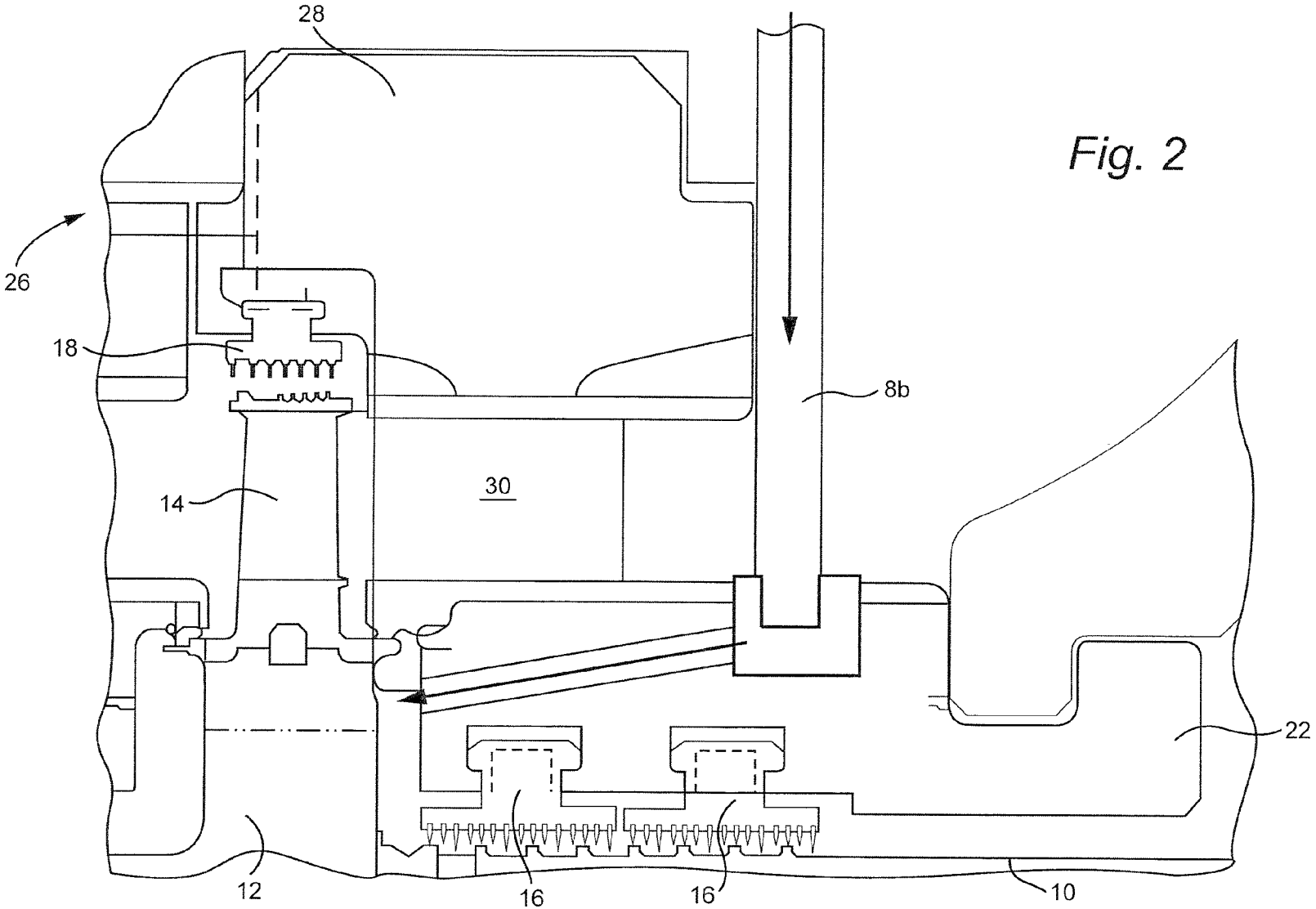
FIG. 2 schematically depicts a first stage upstream wheel space of a turbine being provided with steam in an embodiment of the invention.

Referring to FIG. 2, the cooling steam is introduced into the first stage upstream wheel space through the outer shell 20 of the turbine 24 along the first and second branches 8*a* and 8*b*. Although only the second branch 8*b* is shown in FIG. 2, it should be appreciated that the first branch 8*a* is provided to the bottom half of the outer shell 20 of the turbine 24.

Referring to FIG. 2, the turbine 24 includes a plurality of steam directing nozzles. As shown in FIG. 2, the first stage nozzle 30 is provided immediately downstream of the second branch 8*b* of the cooling steam pipe 8. The steam directing nozzle 30 includes a nozzle diaphragm 26 which includes a nozzle diaphragm outer ring portion 28 and a nozzle diaphragm inner ring portion 22. The nozzle diaphragm 26 is attached to the housing or shell 20 and surrounds the turbine buckets or blades 14 and the nozzle 30. The turbine blades 14 are supported on wheels 12 of the rotor 10 of the turbine 24.

The nozzle diaphragm inner ring portion 22 supports seals 16 provided between the nozzle diaphragm inner ring portion 22 and the outer surface of the rotor 10. The nozzle diaphragm outer ring portion 28 supports spill strip seal rings 18 which surround the turbine blades 14. It should be appreciated that the turbine blades 14 may be provided with a cover on the outer radial surface of the turbine blades 14.

As shown in FIG. 2, the cooling steam is provided from the conduit or pipe 8 into the second branch 8*b* through the housing or shell 20 of a turbine 24 to the first stage upstream wheelspace. The cooling steam is provided upstream of the first stage nozzle 30 in both the upper and lower halves of the shell 20 by, for example, drilling a hole in the shell 20 and the nozzle diaphragm 26 and using a stellite fit arrangement.

Figure 3:
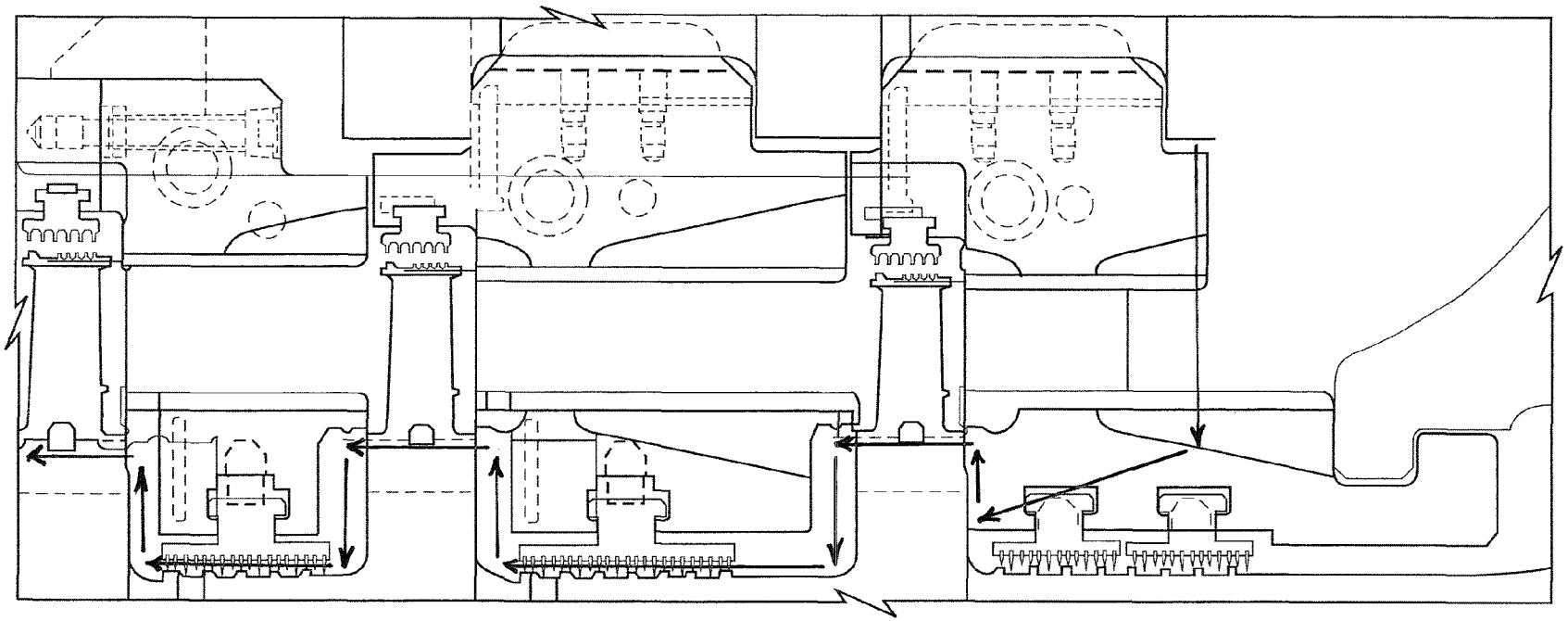
FIG. 3 schematically depicts the travel of the cooling flow through the stages of a turbine in an embodiment of the invention.

Referring to FIG. 3, the flow of cooling steam enters the high pressure (HP) portion of the shell 20 of a turbine 24 through the two branches 8*a* and 8*b* and is then directed into the first stage upstream wheelspace thereby flooding the first stage upstream wheelspace with cooler steam. The cooling flow then travels through steam balance holes to the downstream wheel spaces and then through the packing rings 16 to the second stage upstream wheelspace. The spill strip sealing rings 18 are used to isolate the cooling circuit from the main steam flow. This provides a serpentine cooling arrangement as shown in FIG. 3.

By using the high reaction, full arc first stage in the high pressure expansion turbine 24, the cooling steam limits the metal stresses in the turbine 24 because the cooling steam is provided to the high pressure area of the turbine 24, the cooling flow is provided from the boiler 2, as the pressure needs to be higher than the throttle pressure of the turbine 24.

The control valve 6 is used to regulate the cooling flow by allowing the cooling flow to be adjusted with the load requirements of the turbine 24. This allows the use of a high efficiency, low reaction first stage without compromising the performance of the turbine 24. The configuration shown in FIGS. 1-3 thus allows the turbine 24 to work for a range of loads and the use of the external steam cooling flow from the boiler 2 allows for maximum efficiency over the range of the turbine 24.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine, comprising;

a housing;

a turbine shaft rotatably supported in the housing; and a plurality of turbine stages located along the turbine shaft and contained within the housing, each turbine stage comprising a diaphragm attached to the housing and surrounding the plurality of turbine stages, the diaphragm comprising a plurality of nozzles, wherein at least one hole is provided in the diaphragm upstream of a first stage of the plurality of stages for the introduction of cooling steam.

2. The steam turbine of claim 1, further comprising strip seal rings on an outer ring portion of the diaphragm.

3. The steam turbine of claim 1, wherein the at least one hole comprises two holes provided at opposing locations on the diaphragm.

4. The steam turbine of claim 3, further comprising two conduits passing through the two holes.

5. A method of cooling a high pressure section of a steam turbine, the steam turbine comprising a housing, a turbine shaft rotatably supported in the housing, and a plurality of turbine stages located along the turbine shaft and contained within the housing, each turbine stage comprising a diaphragm attached to the housing and surround the plurality of turbine stages, the diaphragm comprising a plurality of nozzles and at least one hole provided in the diaphragm upstream of a first stage of the plurality of stages, the method comprising:

introducing cooling steam into the steam turbine through the at least one hole.

6. The method of claim 5, further comprising:

regulating the introduction of the cooling steam in accordance with a load on the steam turbine.

7. The method of claim 5, wherein the at least one hole comprises two holes provided at opposing locations, and the method further comprises:

introducing steam into the steam turbine through the two holes.

8. The method of claim 5, wherein the cooling steam is introduced from a final superheater of a boiler.

9. The method of claim 5, further comprising:

isolating the cooling steam from a main steam flow through the steam turbine.

10. The method of claim 9, wherein strip seal rings on an outer ring portion of the diaphragm isolate the cooling steam from the main steam flow.

11. The method of claim 5, wherein the pressure of the cooling steam is higher than the pressure of a main steam flow of the steam turbine through the nozzles.

12. The steam turbine of claim 1, wherein the at least one hole is configured to introduce the cooling steam in a radial direction of the turbine shaft.

13. The steam turbine of claim 4, wherein the two conduits extend from the housing to the diaphragm in a radial direction of the turbine shaft.

14. The steam turbine according to claim 13, wherein the diaphragm comprises an inner ring portion and an outer ring portion, and the two holes are provided in the inner ring portion.

15. The steam turbine according to claim 1, further comprising:

a conduit configured to the carry cooling steam from a boiler to the at least one hole, wherein the conduit extends through the housing and the diaphragm of the first stage nozzle; and a control valve in the conduit configured to regulate the flow of cooling steam.

16. The steam turbine according to claim 15, wherein the conduit is configured to carry the cooling steam from a final superheater of the boiler.

17. The steam turbine according to claim 15, wherein the conduit comprises a first branch and a second branch, and each of the first and second branches extends through the housing and the diaphragm.

18. The steam turbine according to claim 17, wherein the first branch and the second branch extend through the housing and the nozzle diaphragm at opposed locations.

19. The steam turbine according to claim 17, wherein the control valve is upstream of the first and second branches.

20. The method of claim 5, wherein introducing the cooling steam through the at least one hole comprises introducing the cooling steam through the at least one hole in a radial direction of the turbine shaft.

* * * * *